United States Patent [19]

Miller et al.

[11] 4,120,776

[45] Oct. 17, 1978

[54] SEPARATION OF BITUMEN FROM DRY TAR SANDS

[75] Inventors: Jan D. Miller; Jaime E. Sepulveda, both of Salt Lake City, Utah

[73] Assignee: University of Utah, Salt Lake City, Utah

[21] Appl. No.: 828,357

[22] Filed: Aug. 29, 1977

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 1,820,917 | 9/1931 | Langford et al. | 208/11 LE |
| 2,903,407 | 9/1959 | Fischer et al. | 208/11 LE |
| 3,159,562 | 12/1964 | Bichard et al. | 208/11 LE |
| 3,401,110 | 9/1968 | Floyd et al. | 208/11 LE |

*Primary Examiner*—Herbert Levine

[57] ABSTRACT

A process for the separation and recovery of bitumen from dry tar sands or sands with negligible quantities of connate water. The process includes comminuting the tar sands to an average particle size of approximately one centimeter in diameter and digesting the comminuted tar sand in a hot, aqueous solution having a pH within the range of pH 10 to pH 14. Optimal digestion is obtained by assuring that the tar sand in the digester is within the range of 50 to 80% solids so as to provide the necessary high shear environment. The digested tar sand is thereafter subjected to a flotation process wherein additional water is introduced to lower the temperature and the solids concentration. Preferably, the pH of the separation cell is maintained above about pH 10. Air is bubbled into the mixture to carry the separated bitumen particles to the top of the separation cell for subsequent recovery.

4 Claims, 5 Drawing Figures

SEPARATION OF BITUMEN FROM DRY TAR SANDS

The research which resulted in this invention was supported by the State of Utah and the National Science Foundation of the U.S. Government, NSF Grant AER 74-21867.

BACKGROUND

1. Field of the Invention

This invention relates a process for recovering bitumen from a tar sand and, more particularly, to a hot-water recovery process specifically for Utah tar sands, the process utilizing a caustic wetting agent at a controlled pH range in the digester.

2. The Prior Art

The term "tar sand" refers to a consolidated mixture of bitumen (tar) and sand. Alternate names for tar sands are "oil sands" and "bituminous sands", the latter term being more technically correct in that the sense of the term provides an adequate description of the mixture. The sand in tar sand is mostly alpha quartz as determined from X-ray diffraction patterns. The bitumen or tar of the tar sands consists of a mixture of a variety of hydrocarbons and, if properly separated from the sand component, may be used as feedstock for the production of synthetic fuels and/or petrochemicals.

Tar sand deposits occur throughout the world, often in the same geographical areas as petroleum deposits. Significantly large tar sand deposits have been identified and mapped in Canada, Venezuela, and the United States. The Canadian tar sand deposits are known as the Athabasca tar sands and are located in the province of Alberta, Canada. The estimated reserves for the bitumen content in the Athabasca tar sands has been estimated to be approximately 900 billion barrels and, to date, is the only tar sand deposit in the world currently being mined and processed for the recovery of the bitumen content.

Analysis of the Athabasca tar sands indicates an average bitumen content of approximately 12–13% by weight. Importantly, the Athabasca tar sands also have a relatively high moisture content of approximately 3–5%, by weight, connate water. It has, therefore, been postulated by certain investigators that the equilibrium structure of the Athabasca tar sands consists of a sand mixed with but separated from the bitumen matrix by a film of connate water, the connate water surrounding each grain of sand. Accordingly, it is further postulated that the bitumen in the Athabasca tar sands has already been displaced from the sand grains by the connate water. Under these conditions, bitumen separation involves a relatively simple phase disengagement process whereby the bitumen phase is readily disengaged from the sand phase by the conventional hot water separation techniques.

A more comprehensive discussion of the Athabasca tar sands may be found in the literature including, for example, (1) E. D. Innes and J. V. D. Tear, "Canada's First Commercial Tar Sand Development," Proceedings of the Seventh World Petroleum Congress, Elsevier Publishing Co., 3, p. 633, (1967); (2) F. W. Camp, *The Tar Sands of Alberta Canada,* Second Edition, Cameron Engineering, Inc., Denver, Colorado (1974); and (3) J. Leja and C. W. Bowman, "Application of Thermodynamics to the Athabasca Tar Sands," *Canadian Journal of Chemical Engineering,* 46, p. 479 (1968).

Additionally, the following U.S. Patents are a few of the patents which have been granted for apparatus for processes directed toward obtaining bitumen from tar sands: U.S. Pat. Nos. 1,497,607; 1,514,113; 2,871,180; 2,927,007; 2,965,557; 3,161,581; 3,392,105; 3,553,099; 3,560,371; 3,556,980; 3,605,975; 3,784,464; 3,847,789; 3,875,046; and 3,893,907. With the exception of U.S. Pat. No. 3,605,975, each of the foregoing patents have been directed toward processing Athabasca tar sands and are believed, therefore, not directly applicable to processing Utah tar sands as will be set forth more fully hereinafter.

According to a report by the Utah Geological and Mineral Servey, the State of Utah contains at least 25 billion barrels of bitumen in the form of Utah tar sands. This represents approximately 95% of the total mapped tar sand reserves in the United States. Although the Utah tar sand reserves appear small in comparison with the enormous potential of the Athabasca tar sands, the Utah tar sand reserves represent a significant energy resource when compared to the United States crude oil proven reserves (approximately 31.3 billion barrels) and the United States crude oil production of almost 3.0 billion barrels during 1976. Utah tar sands occur in six major deposits along the eastern edge of the state and the bitumen content varies from deposit to deposit as well as within a given deposit. However, the current information available indicates that the Utah tar sand deposits average generally less than 10% bitumen by weight but have been found with a bitumen saturation of up to 17% by weight.

Importantly, unlike the Athabasca tar sands, Utah tar sands have been found to be so dry that no moisture content can be detected by standard analytical techniques. Accordingly, it is obvious that in the absence of connate water, the bitumen is directly in contact with and bonded to, the surface of the sand grains. In addition, tests have also determined that bitumen obtained from Utah tar sands is two orders of magnitude or about 100 times more viscous than bitumen obtained from Athabasca tar sands. Hence, processing of Utah tar sands must involve both bitumen displacement of the bonded bitumen from the sand grains and subsequent phase disengagement of the more viscous bitumen from the sand phase.

Attempts have been made to process Utah tar sands with the hot water processes used for the Athabasca tar sands. However, these attempts have been unsuccessful in light of the recognized differences in the physical and chemical nature of the Utah tar sands, as compared to the Athabasca tar sands. It would, therefore, be an advancement in the art to provide an improved process for recovering bitumen from Utah tar sands or, more particularly, from a tar sand which is characterized by the substantial absence of connate water. It would be an even further advancement in the art to provide a hot-water process for recovery of bitumen from dry tar sands. Such a process is disclosed and claimed in the present invention.

BRIEF SUMMARY AND OBJECTS OF THE INVENTION

The present invention relates to an improved process for separating bitumen from Utah tar sands or tar sands with a negligible connate water content. Bitumen displacement from the sand grains of the tar sands is accomplished by digesting the tar sands under controlled conditions. The controlled conditions in the digester include the percent solids, the pH range as determined by the concentration of the particular wetting agent, and the temperature. A high shear force field in the digester is obtained by maintaining the percentage of solids in the range of 65 to 80%, and, in no case less than 50%. The wetting agent in the digester is maintained in the range of 0.2 normal to 1.0 normal with the most effective range being 0.5 normal to 0.8 normal.

The temperature of the aqueous/solids mixture in the digester is maintained above 70° C. and, preferably, near the boiling point of the aqueous solution. After digestion, separation is achieved in a separation or flotation cell wherein additional water serves as a dilutant to lower the solids concentration below about 50% solids and the temperature to near ambient. Preferably, the pH in the flotation cell is maintained above pH 10. Air is diffused into the separation cell to assist in lifting the bitumen to the surface where it may be collected.

It is, therefore, a primary object of this invention to provide improvements in the process for separating bitumen from tar sands.

Another object of this invention is to provide improvements in the process for the recovery of bitumen from tar sands wherein the tar sands are characterized by the substantial absence of connate water.

Another object of this invention is to provide a hot-water process for the recovery of bitumen from dry tar sands under conditions of a wetting agent having a carefully controlled pH range, solids concentration and temperature.

These and other objects and features of the present invention will become more fully apparent from the following description and appended claims taken in conjunction with the accompanying drawing.

DETAILED DESCRIPTION OF THE PREFERRED EMBODIMENTS

Figure 1:
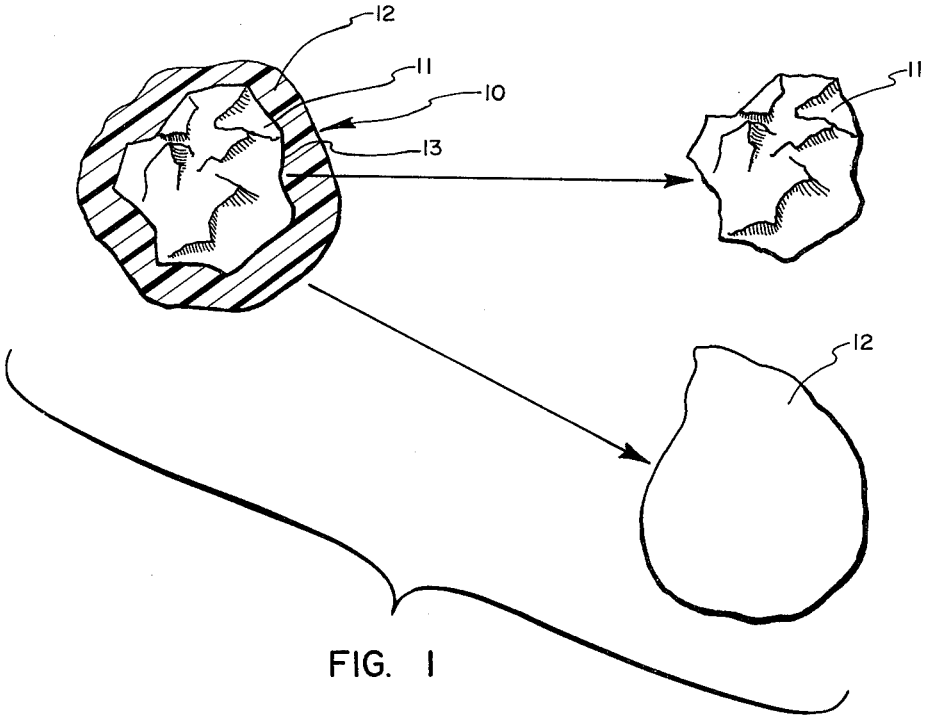
FIG. 1 is a schematic enlargement and illustration of a tar sand particle being separated into its constituent components of a sand grain and bitumen.

The invention is best understood by reference to the drawing wherein like parts are designated with like numerals throughout.

GENERAL DISCUSSION

There are two basic approaches to the recovery of bitumen from tar sands. One approach involves the tar sand being mined and transported to a processing plant where the bitumen is recovered. Alternatively, the extraction of the bitumen is accomplished in situ. Over the past several years, a number of extraction processes have been proposed in the literature. These processes have involved both the surface mining and the in situ processes. However, until recent years, little was known about the potential applicability of any of these processing strategies to tar sands which are characterized by the substantial absence of connate water. This type of tar sand is referred to throughout as Utah tar sands since, at present, the only known tar sands in the world which are characterized by the substantial absence of connate water are those tar sands found in Utah.

Based on the fact that the conventional hot-water process is the only process whose technology is sufficiently well developed and in current use for the primary extraction of bitumen from Athabasca tar sands, the primary objective of the current investigation was to quantify the performance of a similar process for Utah tar sands. The basic hot-water process was initially described in the literature in 1923 and has been repeatedly modified subsequently. Unfortunately, because of the differences in the chemical and physical characteristics between Utah tar sands and Athabasca tar sands, none of the hot-water processes used with the Athabasca tar sands will work when used with Utah tar sands.

Although basically similar in principle to the conventional hot-water process used with the Athabasca tar sands, the actual separation technology in the processing of Athabasca and Utah tar sands differs significantly. In particular, the bitumen in the Athabasca tar sands has already been displaced from the sand grains by the connate water (approximately 3–5% by weight). Under these conditions, bitumen separation for the Athabasca tar sands reduces to a relatively simple phase disengagement process. On the other hand, since the Utah tar sands are essentially dry, the bitumen is directly in contact with and bonded to the surface of the sand grains. Accordingly, processing of Utah tar sands involves both bitumen displacement and phase disengagement operations.

As applied to Utah tar sands, the hot-water process of this invention basically consists of the separation and recovery of bitumen from the Utah tar sands by mixing the raw material with a hot, aqueous solution containing a caustic wetting agent, such as sodium hydroxide, sodium carbonate or sodium silicate. The name of the process arises from the fact that the system is operated at temperatures above 70° C. and, preferably, approaching the boiling point of the water/caustic wetting agent solution.

The resulting strong surface hydration and shearing forces operative at the sand/bitumen interface obtained by the controlled solids and wetting agent concentrations in the digester give rise to the displacement and subsequent disengagement of the bitumen by the aqueous phase. Once the bitumen has been displaced and the sand particles have been liberated, the two phases can be separated by a modified froth/flotation technique based on the natural hydrophobicity exhibited by the free bituminous droplets.

Surprisingly high coefficients of separation and recoveries of bitumen in the concentrate have been obtained by the process of this invention although the precise mechanism by which bitumen is displaced from the surface of the Utah tar sand particle is not well understood. The coefficient of separation is defined herein as the fraction of the feed material which undergoes a perfect separation while the rest of the feed material is distributed unchanged into the respective product streams.

Investigators have attempted to explain bitumen displacement by postulating a surface energy balance while other investigators have analyzed the displacement by consideration of a chemical reaction between the hydrated silica surface and the hydroxyl radicals present in the caustic solution; which in turn, results in the displacement of the bitumen from the sand grains. However, even these theories are of limited application because of the complexity of the interactions between the different phases of the sand-bitumen-water system. Accordingly, the process of the present invention is directed toward identifying and quantifying the main variables which deserve primary consideration for a scale-up of a process for the recovery of bitumen from Utah tar sands.

THE EMBODIMENTS OF THE INVENTION

With particular reference to FIG. 1, a discrete particle of Utah tar sand is illustrated generally at 10 and includes a grain of sand 11 coated with a layer of bitumen 12. In the illustration of FIG. 1, the bitumen 12 is shown in partial cross section to reveal the relationship between bitumen 12 and sand grain 11. In particular, bitumen 12 is bonded to sand grain 11 at interface 13 to further demonstrate the absence of connate water as would otherwise be encountered, for example, with the Athabasca tar sands (not shown), as discussed previously.

Additionally, the size relationship between the thickness of the layer of bitumen 12 and sand grain 11 may appear somewhat out of proportion particularly in light of the relatively low percentages (8–15%) of bitumen in the Utah tar sands as set forth hereinbefore. However, the illustration of FIG. 1 was prepared to demonstrate the bonding of bitumen 12 to sand grain 11 at interface 13 versus the layer of connate water found in the Athabasca tar sands as discussed previously. Additionally, tests conducted on samples of Utah tar sand obtained from a deposit known as the Asphalt Ridge deposit determined that these tar sands have a particle size distribution of sand grains 11 ranging from about 10 micrometers to about 500 micrometers. Although a discrete particle of tar sand 10 is shown, it should be particularly emphasized that Utah tar sand consists of a plurality of sand grains 11 bonded together in a general agglomeration by a matrix of bitumen 12.

Figure 2:
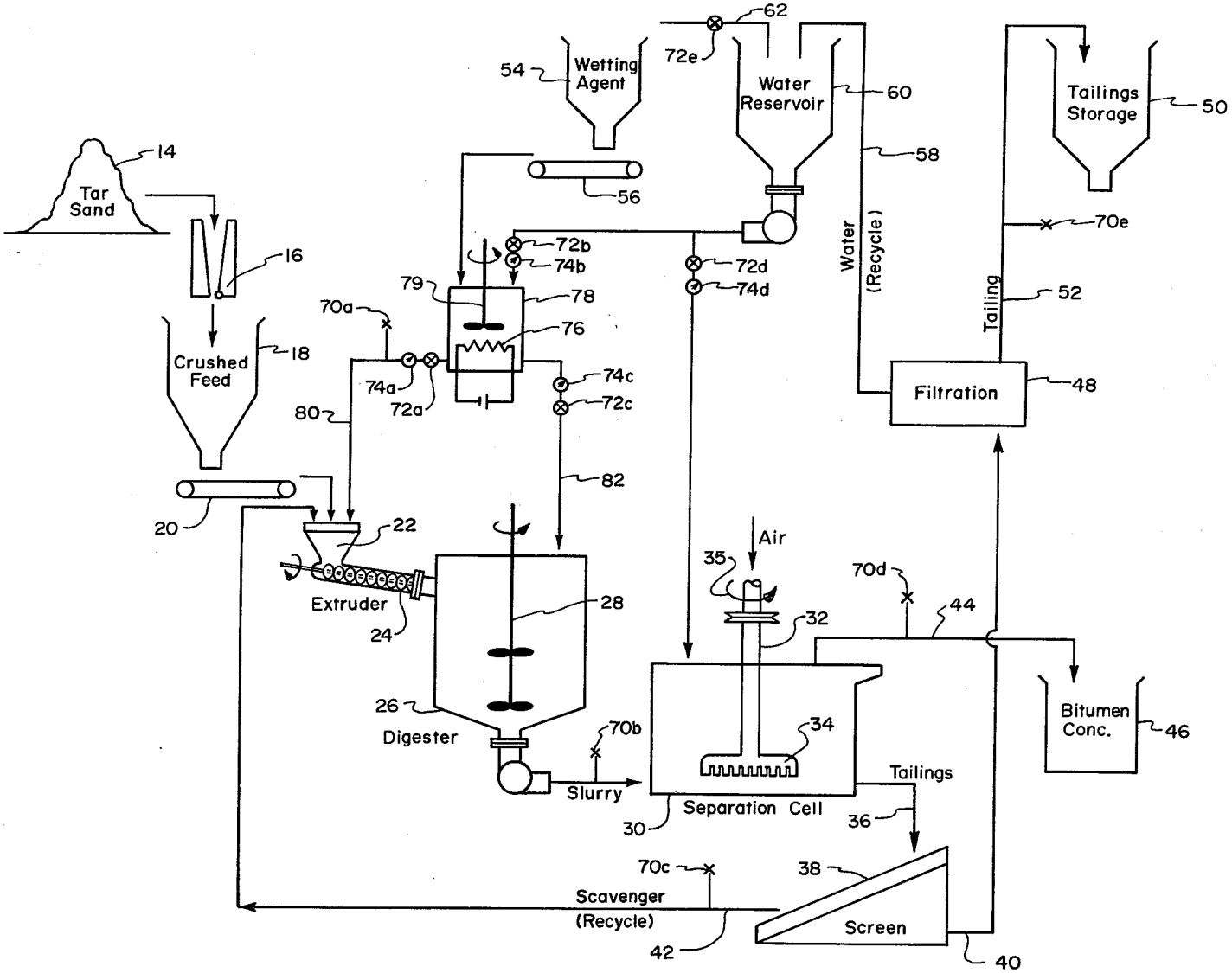
FIG. 2 is a complete flow diagram illustrating the process of the present invention.

Referring now more particularly to FIG. 2, a flow diagram of one possible process utilizing the novel features of this invention is illustrated. A tar sand 14 is obtained by conventional mining techniques and is crushed in a crusher 16 to achieve a suitable size reduction for exposure of the bitumen therein to the subsequent digestion action. Due to the low bitumen ratios of Utah tar sands, these tar sands generally can be crushed to obtain the desired size reduction. This may be supplemented, however, with an extrusion step, for example, as with an extruder 24 to achieve a final particle size reduction.

The physical characteristics of Utah tar sands with respect to crushing versus extrusion seem to dictate a shift from one technique to the other at about 8% bitumen. Below about 8%, crushing appears more favorable, while above about 8%, the tar sand becomes more plastic thereby indicating extrusion as the favored technique for size reduction.

The comminuted tar sand is maintained as a crushed feed in a crushed-feed hopper 18 and distributed into a feed hopper 22 of an extruder 24 by a conveyor 20. Extruder 24 introduces the crushed feed into a digester 26. Extruder 24 is also used to reduce the size of the tar sand to a smaller size (approximately 1 centimeter in diameter) where desired. Extrusion is facilitated by introduction of hot, caustic solution through an inlet line 80 into feed hopper 22.

The hot, caustic solution is prepared in a mixing tank 78. The particular caustic or wetting agent is stored in a wetting agent hopper 54. The wetting agent is stored as a dry solid and fed by a conveyor 56 into mixing tank 78. Water from a water reservoir 60 is introduced through a valve **72*b* into mixing tank 78 where an impellor 79 suitably mixes the wetting agent and the water. A heater 76 is used to suitably heat the wetting agent or caustic/water solution for subsequent introduction into either the feed hopper 22 or directly into digester 26**.

In digester 26, the controlled solids concentration consisting of a slurry of tar sand and hot, caustic solution is suitably stirred to provide the necessary digestion of the tar sand. Optimum digestion of the tar sand has been found to occur with a caustic concentration range between 0.2 normal and 1.0 normal, and a solids ratio between 50 and 80% solids as will be set forth more fully hereinafter, and a temperature above about 70° C. Preferably, the temperature in digester 26 is maintained near the boiling point of the solution.

The excellence of the separation of bitumen from tar sand as obtained by this process can be quantified not only by the grades of the products and the recovery of the different components but also by the coefficient of separation. The coefficient of separation is defined as the fraction of the feed material which undergoes a perfect separation while the rest of the feed is distributed unchanged into the respective product streams, concentrate and tails. In terms of recoveries, it can be shown that the coefficient of separation is equal to the difference between the recovery of bitumen in the concentrate and the recovery of the sand in the same concentrate. Because of its significance, the coefficient of separation provides an adequate, single parameter description of the overall process performance.

Experimental data developed during the making of this invention demonstrated that high shear digestion was important for obtaining optimum removal of the bitumen from the sand. Further experimental work substantiated the theory that a high intensity agitation alone did not necessarily result in strong shearing conditions. In fact, process performance was shown to be independent of the intensity of agitation in the range of values studied (510–1250 RPM). On the other hand, the percentage of solids in the digester 26 was shown to have a significant effect on the coefficient of separation. The solids ratios in digester 26 for optimum high shear conditions were found to be optimum in the range of 65 to 80% and by no means lower than 50%.

Figure 3:
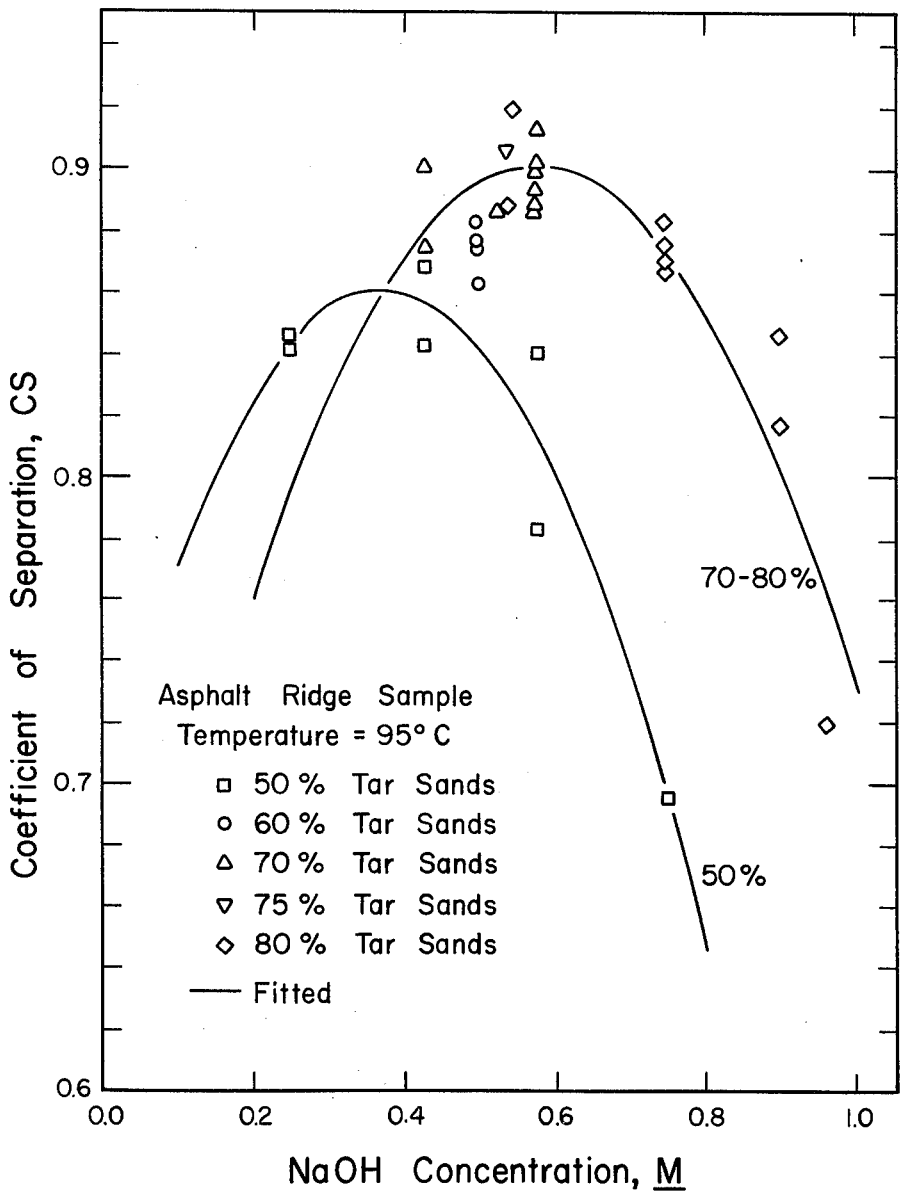
FIG. 3 is a diagram comparing the coefficient of separation with caustic concentration for different percentage solids in the digester.

The foregoing can be readily demonstrated by reference to FIG. 3 wherein the coefficient of separation was plotted against the caustic wetting agent concentration for samples having different percentages of solids in the digester 26. It is noted that the curve representing data for the sample run with 50% solids uses a lower concentration of caustic wetting agent but also has a lower coefficient of separation. Although a lower concentration of caustic wetting agent may appear favorable, it was also found that a caustic concentration generally lower than about 0.4 normal (and definitely lower than 0.2 normal) resulted in an acidic, sticky bitumen which adhered to the walls of digester 26 and generally interferred with the process. On the other hand, an excessively high caustic addition (above about 1.0 normal) tends to neutralize the hydrophobic nature of the bitumen thus also lowering the coefficient of separation in the separation cell, the operation of which will be discussed more fully hereinafter.

Optimum digestion also requires that the temperature of the digester 26 be maintained close to the boiling point of the solution. In order to test the hypothesis that the quality of the separation should deteriorate at lower temperatures because of the increase in bitumen viscosity, a series of experiments was performed with Utah tar sands from the Asphalt Ridge deposit. The solids concentration was set at 75% and the caustic at 0.58 moles/liter sodium hydroxide. Although the grade of concentrate (bitumen) remained fairly constant throughout the temperature range evaluated, the coefficient of separation drop off was generally linear to 70° C. (0.9 at 95° C. and 0.7 at 70° C.) but thereafter rapidly dropped to 0.37 at 57° C.

Digestion was continued for sufficient time to obtain the suitable separation of the bitumen from the sand grains. Thereafter, the digested tar sand slurry was directed into separation cell 30 for separation of the bitumen phase from the sand phase. The grade of the concentrate or bitumen product obtained from separation cell 30 was found to be a function of pH, solids concentration, air flow rate through diffusor 34, and the degree of agitation imparted to the contents of separation cell 30 by the air flow rate and rate of rotation of diffuser 34 as indicated schematically by arrow 35. Any of the foregoing physical factors will also determine, to a substantial degree, the quantity of fines carried over with the bitumen 12 (FIG. 1) and, therefore, the grade of the bitumen. It was found desirable to maintain the sand grains in separation cell 30 in a fluidized state so as to permit the bitumen to float upwardly. This was achieved by suitably diluting the slurry from digester 26 with sufficient water to obtain a solids ratio below about 50% solids, and, desirably, about 20% solids. The fluidized state of the slurry mixture was maintained by agitating the mixture with diffuser 34 while injecting air therein through diffuser 34. Care was taken to prevent excessive agitation while maintaining the fluidized state of the sand.

In one experimental example, a cylindrical, three-liter cell was used with an air flow rate of 3000 cubic centimeters per minute accompanied by rotation of diffusor 34 at 1000 RPM. Since bitumen from Utah tar sands has a specific gravity of about 1.1, air flow provides a necessary modified froth/flotation separation. In particular, the bitumen droplets tend to adhere to the air bubbles and are thereby lifted to the surface of the slurry in separation cell 30.

The pH of separation cell 30 is maintained above about pH 10 to obtain a faster and higher quality separation since the bitumen droplets float faster and the sand residue floculates and settles more rapidly. Clearly, lower pH ranges can be used in separation cell 30; however, the fines tend to remain suspended and the solution is more turbid thereby creating additional filtration problems.

It was further found desirable to lower the temperature of the slurry in separation cell 30 in order to reduce the tendency for the bitumen to be tacky. Thus, at about ambient temperature, there was less tendency for the bitumen to agglomerate and be carried out with the tailings 36. In practice, the hot mixture from digester 26 was diluted with water at ambient temperature (about 15° C.) resulting in a final temperature of about 25° C. to 30° C.

EXAMPLE I

In one operative example of the process of this invention, Utah tar sands obtained from the Asphalt Ridge deposit were extruded to an average size less than about 1 centimeter in diameter and introduced into a hot, caustic solution in digester 26 where the tar sands constituted 70% by weight of the slurry in digester 26. The wetting agent for this first example was sodium hydroxide at a concentration of 0.58 moles/liter or 0.58 normal. Agitation of the slurry in digester 26 was obtained by an impeller 28 with two opposing pitched blade turbines rotated at 750 RPM. The temperature of the slurry in digester 26 was maintained at 95° C. and digestion was continued for 15 minutes.

The resulting digested slurry from digester 26 was introduced into a separation cell 30, where additional water and caustic were added. The percent solids in separation cell 30 was 20% by weight solids. The pH of separation cell 30 was maintained above pH 10. The resulting slurry in the separation cell was agitated by rotating diffuser 34 at 1000 RPM and introducing air through diffuser 34 at a flow rate of 3000 cc per minute (based upon a 3-liter separation cell).

The results of the foregoing Example I are tabulated in Table I as a comparison between the initial feed, the bitumen concentrate or product, and the tail or tailings. In the particular tar sand utilized in Example I, the Utah tar sand had a bitumen content of 12.8% (by weight) of which 96.4% was recovered in the concentrate which, incidently, would require additional upgrading at a refining plant. This is indicated by the grade percent of 64.8% bitmuen and 35.2% sand in the recovered concentrate.

In addition, it should be pointed out that the results of Example I were obtained from a single stage process so that the coefficient of separation was 0.887. This value could certainly be improved by multiple stage processing.

TABLE I

CALCULATED MASS BALANCE FOR PROCESS OF EXAMPLE I
(All figures in dry weight percent)

| | Weights | Grade | | Recovery | |
|---|---|---|---|---|---|
| | | Tar | Sand | Tar | Sand |
| Concentrate | 19.1 | 64.8 | 35.2 | 96.4 | 7.7 |
| Tail | 80.9 | 0.6 | 99.4 | 3.6 | 92.3 |
| Feed | 100.0 | 12.8 | 87.2 | 100.0 | 100.0 |

Coefficient of Separation = 0.887

EXAMPLE II

A second series of experiments were conducted utilizing Utah tar sand samples obtained from the P. R. Springs deposit. Digestion was conducted at 93° C. with sodium silicate as the wetting agent. The ratio of wetting agent in solution was 5% of the solids (tar sands) or 1 gram sodium silicate for 20 grams tar sand. The tar sand ratio in the digester was 67% by weight and was digested at 1000 RPM for 15 minutes. Flotation was conducted with 20% by weight solids and at 15° C. Diffuser 34 was rotated at 1200 RPM. The results of Example II are tabulated in Table II.

TABLE II

CALCULATED MASS BALANCE FOR PROCESS OF EXAMPLE II
(All figures in dry weight percent)

| Weights | | Grade | | Recovery | |
|---|---|---|---|---|---|
| | | Tar | Sand | Tar | Sand |
| Concentrate | 20.4 | 70.5 | 29.5 | 99.1 | 7.0 |
| Tail | 79.6 | 0.2 | 99.8 | 0.9 | 93.0 |
| Feed | 100.0 | 14.5 | 85.5 | 100.0 | 100.0 |

Coefficient of Separation = 0.921

Referring again to FIG. 2, the bitumen concentrate obtained from separation cell 30 was removed through a line 44 to a holding tank 46. Thereafter, the bitumen concentrate would be directed to a suitable upgrading process and subsequent refining.

The tailings from the separation cell 30 are removed along with the aqueous solution at an outlet 36 and passed through a screen 38. Screen 38 is necessary since, on occasions, relatively large lumps of non-floatable bitumen are found in the sand tails. This material is recovered from the tails by simply screening on screen 38 which, in this instance, is a 14-mesh, vibratory screen. It was found that the scavenged concentrate from screen 38 had a sufficiently high grade to accommodate being either recycled as recycle 42 into extruder hopper 22 or refined as is by being diverted to bitumen concentrate 46.

The hydrophilic free sand particles are recovered from the bottom of the separation cell 30 as tailings 36 where they are passed through screen 38 as sand tails 40. Sand tails 40 are introduced into a filter 48 and subjected to filtration to recover the water therefrom, the water being directed as recycle water 58 into water reservoir 60. The sand tailings 52 obtained from filter 48 are then directed to tailing storage 50. As set forth hereinbefore with respect to Examples I and II and Tables I and II, it can be seen that the sand tailings have very little bitumen therein and may be suitably utilized for various processes involving a relatively clean, finely particled sand or may even be returned to the tar sand deposit as a first step in the subsequent reclamation of the tar sand excavation.

To assure adequate control of the process parameters, a plurality of sample ports **70*a*–70*e* are provided for taking of samples at various stages of the process. Additionally, a plurality of valves 72*a*–72*e* allow for control of the water and/or water/caustic solution with a plurality of flow meters 72*a*–72*d* providing the necessary indication to permit suitable adjustment of valves 72*a*–72*d***.

From the foregoing flow diagram of the process of FIG. 2, it can be seen that maximum utilization of the water is obtained particularly by means of water recycle 58 so that the primary function of water inlet 62 is a makeup for water reservoir 60. Although the concept of water recycle is a well-known technique in numerous processes, it is of critical importance in view of the fact that the Utah tar sands, which are the primary focus of this invention, are located in a relatively arid portion of the State of Utah.

Figure 4:
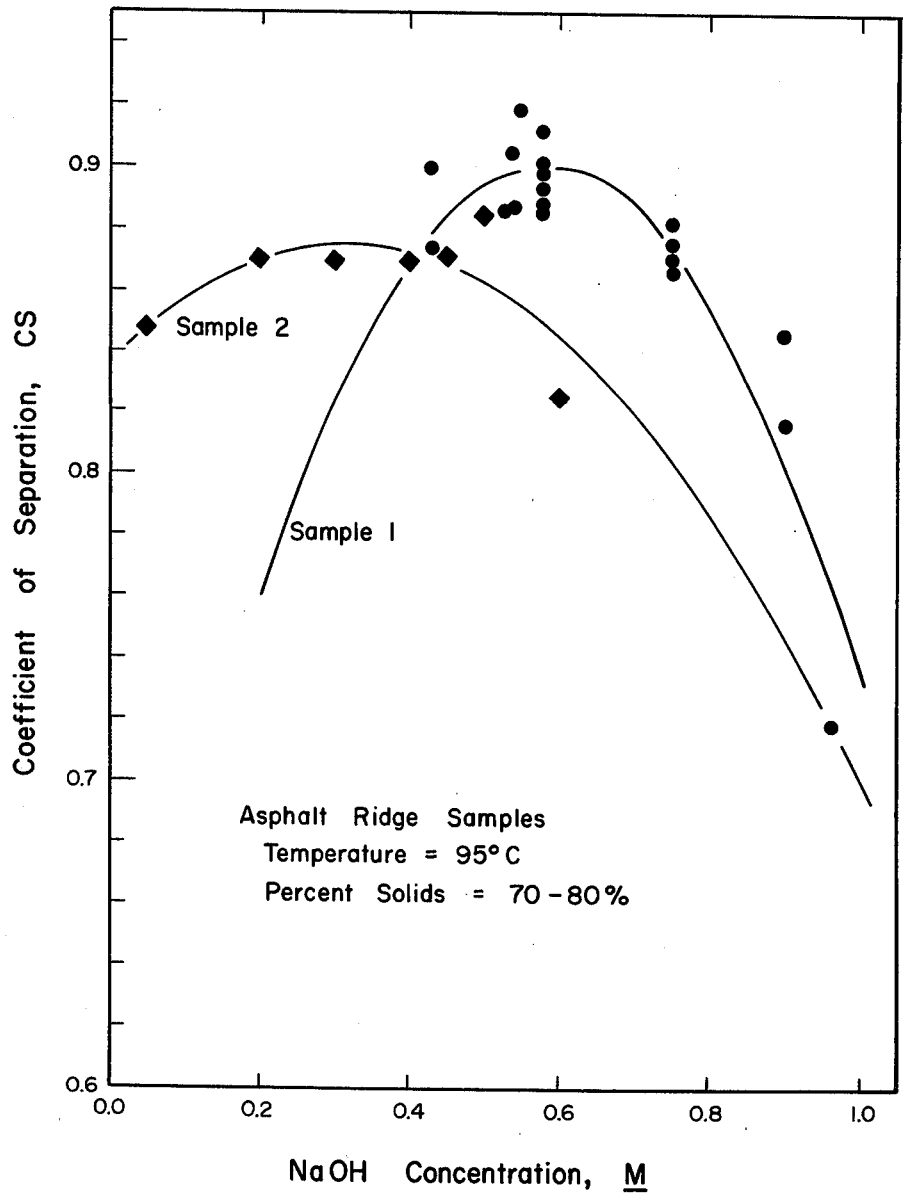
FIG. 4 is a diagram comparing the coefficient of separation as a function of caustic concentration for two different samples.

With particular reference again to FIG. 3 and to FIG. 4, the coefficient of separation (CS) is compared to the sodium hydroxide concentration (molar) for various samples and percent solids in the digester.

In each of FIGS. 3 and 4, it will be seen that an improved coefficient of separation was obtained for the higher percentage of solids in digester 26 (70–80% by weight solids). This was a result of the need for a high shear environment in the digester in order to achieve both bitumen displacement and phase disengagement. The high shear environment is obtained by the relatively high optimum percent solids in the digester since it was experimentally determined that a high intensity of agitation does not necessarily result in strong shearing conditions. In fact, the digester performance was shown to be independent of the intensity of the agitation in the range of values studied (510–1250 RPM). It is believed that the high shear environment is obtained as the particles of tar sand and bitumen grind or otherwise abrade against each other thereby imparting the shear action necessary to displace the bitumen 12 (FIG. 1) from the sand grain 11 (FIG. 1).

Probably the most critical variable in the digestion process is the wetting agent concentration. It was found that a low caustic addition (below about 0.2 normal) results in an excessively acidic, sticky bitumen concentrate and, correspondingly, a tail which contains a significant amount of bitumen. On the other hand, an excessively high caustic addition (above 1.0 normal) neutralizes the hydrophobic nature of the bitumen and, therefore, the bitumen cannot be suitably recovered by flotation.

It should be further pointed out that the results obtained and set forth in FIGS. 3 and 4 were developed through samples taken from the Utah tar sand deposit identified as the Asphalt Ridge deposit. Accordingly, samples obtained from other deposits may slightly alter the optimum ratios of the caustic concentration.

Figure 5:
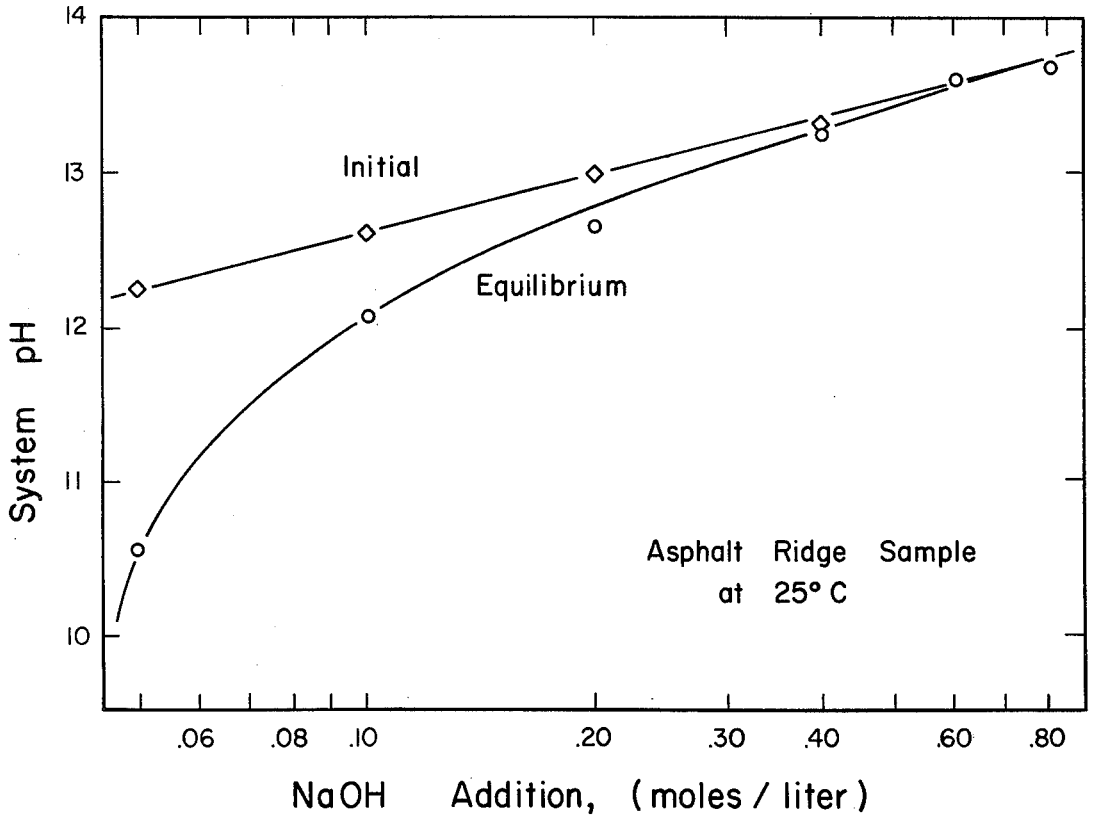
FIG. 5 is a diagram illustrating the comparison between system pH and the addition of caustic.

With particular reference to FIG. 5, the general acidic nature of the bitumen in Utah tar sands is illustrated by comparing the initial pH of the tar sand with the pH of the overall system after digestion with caustic. The difference between the two lines (initial and equilibrium) represents the amount of base consumed in neutralizing acid groups on the tar sand. This neutralization is necessary in order to obtain suitable phase displacement of the bitumen from the sand grains. This is further shown at caustic concentrations above 0.4 normal wherein the two lines nearly coincide and which concentration is the minimum practical caustic concentration for efficient digestion.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for displacing bitumen from grains of sand in a tar sand having a negligible quantity of connate water comprising the steps of:

obtaining a tar sand having a negligible quantity of connate water;

comminuting the tar sand to obtain particles of tar sand; and digesting the particles of tar sand to displace bitumen from the grains of sand comprising the steps of:

preparing a digestion solution comprising an aqueous solution of caustic wetting agent, the caustic wetting agent being present in the digestion step in a concentration within the range on the order of about 0.2 normal to 1.0 normal thereby maintaining the pH above about 10;

maintaining the temperature of the digestion solution within the range on the order of about 70° C. to the boiling point of the digestion solution; and displacing bitumen from the grains of sand with a high shear environment by mixing the particles of tar sand with the digestion solution in an amount to provide a solids concentration within the range on the order of about 50 to 80%, the displacing step further comprising agitating the mixture thereby providing the high shear environment for displacing the bitumen from the grains of sand.

2. The process defined in claim 1 wherein the digesting step further comprises preparing a digestion solution by selecting a caustic wetting agent from the group consisting of sodium hydroxide, sodium carbonate, and sodium silicate.

3. The process defined in claim 1 wherein the digesting step further comprises separating displaced bitumen from the sand grains comprising treating the digested particles of tar sand with a modified flotation technique including a flotation cell containing tar sand particles and digestion solution to which additional water and caustic wetting agent have been added thereby forming a flotation suspension while maintaining the pH of the flotation solution above about pH 10 comprising the steps of:

preparing a flotation solution by diluting the digestion mixture with a dilution solution of water and caustic wetting agent;

maintaining the pH of the flotation solution above about pH 10 by adjusting the amount of caustic wetting agent in the dilution solution;

lowering the solids concentration in the flotation cell to below about 50%;

lowering the temperature below about 60° C. by the diluting portion of the preparing step;

agitating the mixture in the flotation cell with sufficient agitation to fluidize the sand grains without excessive carry over of the sand grains; and air lifting bitumen upwardly through the agitated mixture with air by diffusing air bubbles upwardly through the agitated mixture, the air bubbles lifting bitumen upwardly thereby separating bitumen from the sand grains in the flotation cell.

4. A process for displacing bitumen from grains of sand in a tar sand having a negligible quantity of connate water comprising the steps of:

obtaining a tar sand having a negligible quantity of connate water;

comminuting the tar sand to obtain particles of tar sand;

digesting the particles of tar sand to displace bitumen from the grains of sand comprising the steps of:

preparing a digestion solution comprising an aqueous solution of caustic wetting agent, the caustic wetting agent being selected from the group consisting of sodium hydroxide, sodium carbonate, and sodium silicate and present in the digestion step in a concentration within the range on the order of about 0.2 normal to 1.0 normal thereby maintaining the pH above about 10;

maintaining the temperature of the digestion solution within the range on the order of about 70° C. to the boiling point of the digestion solution; and displacing bitumen from the grains of sand with a high shear environment by mixing the particles of tar sand with the digestion solution in an amount to provide a solids concentration within the range on the order of about 50 to 80%, the mixing step further comprising agitating the mixture thereby providing a high shear environment for displacing bitumen from the grains of sand; and separating displaced bitumen from sand grains comprising treating the digested particles of tar sand in a flotation cell comprising tar sand particles and digestion solution with additional water and caustic wetting agent thereby forming a flotation solution while maintaining an alkaline pH in the flotation solution above about pH 10 comprising the steps of:

preparing a flotation solution by diluting the digestion mixture with a dilution solution of water and caustic wetting agent;

maintaining the pH of the flotation solution above about pH 10 by adjusting the amount of caustic wetting agent in the dilution solution;

lowering the solids concentration in the flotation cell to below about 50% and also the temperature below about 60° C. by the diluting portion of the preparing step;

agitating the mixture in the flotation cell with sufficient agitation to fluidize the sand grains without excessive carry over of the sand grains; and air lifting bitumen upwardly through the agitated mixture with air by diffusing air bubbles upwardly through the agitated mixture, the air bubbles forming a froth and lifting bitumen upwardly thereby separating bitumen from the sand grains in the flotation cell.

* * * * *